US006587665B2

(12) United States Patent
Bartscher et al.

(10) Patent No.: US 6,587,665 B2
(45) Date of Patent: Jul. 1, 2003

(54) DIGITAL PRINTER OR COPIER MACHINE AND PROCESSES FOR FIXING A TONER IMAGE

(75) Inventors: Gerhard Bartscher, Köln (DE); Gerald Erik Hauptmann, Bammental (DE); Frank-Michael Morgenweck, Molfsee (DE); Domingo Rohde, Kiel (DE); Detlef Schulze-Hagenest, Molfsee (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/022,692

(22) Filed: Dec. 17, 2001

(65) Prior Publication Data

US 2002/0136574 A1 Sep. 26, 2002

(30) Foreign Application Priority Data

Dec. 22, 2000 (DE) ..... 100 64 569
Jul. 23, 2001 (DE) ..... 101 35 789

(51) Int. Cl.[7] ..... G03G 15/20
(52) U.S. Cl. ..... 399/336
(58) Field of Search ..... 219/216; 399/67, 399/69, 70, 320, 335, 336; 430/106, 110

(56) References Cited

U.S. PATENT DOCUMENTS 4,434,353 A * 2/1984 Marsh et al. ..... 219/216
4,444,487 A 4/1984 Miller et al.
6,210,849 B1 * 4/2001 Fukuda et al. ..... 430/106

FOREIGN PATENT DOCUMENTS

DE 29 33 691 C2 3/1980
DE 30 17 898 A1 1/1981
DE 29 33 724 A1 3/1981
DE 37 38 487 C2 5/1988
DE 43 39 338 C2 9/1994

* cited by examiner

*Primary Examiner*—Hoang Ngo
(74) *Attorney, Agent, or Firm*—Lawrence P. Kessler

(57) ABSTRACT

Digital printers or copier machines (1) and processes to be performed using them, for fixing a toner image (5) transferred onto an image-carrier substrate (9), are proposed. One of the processes is characterized in that to fuse the toner particles, at least two electromagnetic radiation pulses are applied in a time-delayed manner onto the same area of the image-carrier substrate (9) and each one individual radiation pulse being in a range from 0.5 J/cm$^2$ to 5 J/cm$^2$.

19 Claims, 6 Drawing Sheets

DIGITAL PRINTER OR COPIER MACHINE AND PROCESSES FOR FIXING A TONER IMAGE

FIELD OF THE INVENTION

The invention involves a process for fixing a toner image transferred onto an image-carrier substrate, a process for fixing a single-color or multi-color toner image transferred onto an image-carrier substrate, a digital printer or copier machine that has a fixing device for fixing a toner image onto an image-carrier substrate, and a digital printer or copier machine, wherein at least two electromagnetic radiation pulses are applied in a time-delayed manner onto the same area of the image-carrier substrate.

BACKGROUND OF THE INVENTION

A known process is electrostatic printing, in which a latent electrostatic image is developed by charged toner particles. These particles are transferred onto an image-carrier substrate, such as paper, for example, hereinafter referred to simply as "substrate". Afterwards, the developed image that has been transferred onto the substrate is fixed by the toner particles being heated and fused, and possibly the substrate being heated. In order to fuse the toner particles, contacting processes are often used in which the toner particles are brought into contact with suitable devices, for example, hot rollers or cylinders. It is disadvantageous that the design, the maintenance and the operating costs of these heating devices that operate by contact are expensive and thus cost-intensive. In addition, it is usually necessary to use silicone oil as a separating agent that should prevent an adhesion of the fused toner onto the heating device. Furthermore, the defect rate, especially paper jams, caused by the contacting heating devices, is relatively high.

In order to fix the toner that is transferred onto the paper, for example, heating devices and processes are also known that operate in a non-contact manner, in which for example, the toner particles are fused, for example, using heat radiation and/or microwave radiation or with hot air, so that they adhere to the paper.

A known fixing device has a xenon lamp that is arranged above the transport path of the paper. Using the xenon lamp that is electrically powered by a power supply unit, a flash/radiation pulse or a continuous radiation can be applied onto the paper when the paper is guided past the xenon lamp. The toner image is fused, by the clocked or continuous electromagnetic radiation, and liquefies so that after it has cooled off, it adheres in a desirable manner to the paper surface. Xenon flash lamps emit electromagnetic radiation, mainly in the visible and near infrared wavelength range, in which the toner has a high absorption and the paper has only a low absorption. This known phenomenon leads to a non-uniform heating of the areas of the toner image, which have variably high toner densities. In the areas of the toner image with a low toner density, in which the toner particles are arranged more or less individually, the toner temperature is clearly lower than in the areas with a high toner density, because the areas with the high toner density absorb a large portion of the electromagnetic radiation. This different absorption behavior leads to a non-uniform fusing of the toner image in the areas with varying toner density. If the toner image is impinged with an energy that is so high that the toner is also fused in the areas with a low toner density, the so-called "micro-blistering" frequently occurs in the areas of the toner image with a high toner density, i.e. a bubble forms within the fused toner layer as a result of overheating of the toner and possibly the paper. It is disadvantageous in this that the gloss of the toner image is influenced in an undesirable manner. Furthermore, a partial overheating of the paper can occur, so that it begins to undulate.

Xenon flash lamps for fixing a single color (black) toner image, which emit electromagnetic radiation in the visible and short infrared range, have been known for a long time. The absorption capacity of the toner in the three process colors cyan, magenta, and yellow on the one side and the absorption capacity of black toners on the other side differ considerably in the wavelength range emitted from the xenon flash lamp. The process color-toner portions absorb only in a very narrow wavelength spectrum in the visible range and customarily absorb less than 10% in the near infrared range. Black toners absorb approximately 100% in the aforementioned wavelength ranges. These varying absorption characteristics lead to a non-uniform fusing of the toner image when the light of a xenon flash lamp is used to fix the toner image. A non-uniform fusing of the toner image leads to a non-uniform fixing of the toner, to a non-uniform gloss, to a partial bubble formation in the toner image or to a partial overheating and discoloration of the paper. This effect is especially yielded between the three process colors cyan, magenta, and yellow, which absorb the electromagnetic radiation emitted from the xenon flash lamp differently, but each selectively in a wavelength range between 0.25 $\mu$m and 2 $\mu$m, in particular in the range 0.4 $\mu$m and 1 $\mu$m. In this wavelength range, black toner absorbs approximately 100% of the electromagnetic radiation.

In order to match the absorption capacity of the process color toners to each other, an infrared absorber is added to them, for example, such that they obtain the same absorption characteristic as black toner in a wavelength range between 700 nm and 2 $\mu$m. These types of absorbers, however, are not completely colorless in the visible range, so that they act in a disadvantageous way on the color reproduction. The better the absorption capacities of the process color toners are matched to each other using the infrared absorbers, the greater is their overlap with the visible range.

SUMMARY OF THE INVENTION

The purpose of the invention is to provide a process in which the toner to be fixed is fused using electromagnetic radiation, whereby the areas of the toner image with higher and with lower toner density have at least approximately the same fusing quality. Another purpose of the invention is eliminating defects in the toner image, which result due to a non-uniform energy absorption of the toner image. Another purpose is providing a process in which the process color toners impinged with electromagnetic radiation and the black toner have an improved uniformity in their absorption capacity. Finally, another purpose of the invention is to provide a digital printer or copier machine to perform the process.

In order to achieve the purpose, a process is characterized in that in order to fuse the toner particles at least two electromagnetic radiation pulses are applied onto the same area of the image substrate in a time-delayed manner. The second radiation pulse/flash is then triggered, for example, when the intensity of the first radiation pulse/flash has been reduced to a certain value. The term "time-delayed" is understood here to be the time duration between the triggering of the first radiation pulse/flash and the triggering of the second radiation pulse/flash. It has been revealed that by the time-delayed application of the second radiation pulse, the limit value of the energy, at which the toner image is overheated, increases. According to the invention, it is thus possible that to fuse areas of the toner image with high and low toner density, the same energy can be applied to each, without a bubble formation occurring in the fused toner layer in areas with high toner density. The energy of each individual radiation pulse is in each case below the limit energy at which a bubble formation would occur in the molten mass in the areas of the toner image with high toner density. The total of the energy of all radiation pulses is in any case so high that even areas of the toner image with low toner density are fused in the desired way and in this way fixed onto the image-carrier substrate. With process according to the invention, an at least approximately equivalent fusing quality of the areas of the toner image with high and with low toner density can thus be ensured. In addition, it is advantageous that damage to the toner image and the image-carrier substrate as a result of excessive heating is avoided.

In the following, a brief description is given of what the term "toner density" means in connection with the invention presented here: In a color print, the toner image can have four different colored toner layers, for example, whereby usually one of the toner layers is black, yellow, magenta, or cyan. The maximum density of each toner layer on the image-carrier substrate is 100% corresponding to a density measured in transmission of approximately 1.5, whereby a maximum total density of the toner layers/toner image of 400% is produced. Usually the density of the toner image is in a range from 10% to 400%. A toner image with only a 10% density is mainly formed by individual toner particles on the image-carrier substrate. The energy required to fuse a toner image with a toner density of 10% is distinctly higher than the energy that is required to fuse a toner image with a toner density of 400%.

In a preferred embodiment form, the total radiation energy density of the at least two radiation pulses, which is required to fuse the toner in the desired manner, is equally as large at very low toner densities, i.e. 10% for example, and at high toner densities, i.e. 290% or more. Since a toner image usually has areas with high and with low toner densities, it can be ensured that none of these areas, especially also those with a high toner density, are overheated and that the entire toner image is fused uniformly.

The principle of the aforementioned process is characterized in that the maximum radiation energy of each radiation pulse is less than the limit energy density, at which bubble formation would begin when it is transmitted onto the toner image having a toner layer with a high toner density and/or having the highest toner density. The level of the radiation energy density of at least two radiation pulses is, however, sufficiently high so that after the last of the radiation pulses has been applied onto the toner image and/or onto the area to be fixed, the radiation energy density required for fusing of the toner area was transferred onto it.

An embodiment example of the process is preferred in which the total radiation energy density of the at least two radiation pulses is in a range from 1 J/cm$^2$ to 18 J/cm$^2$, preferably from 3 J/cm$^2$ to 10 J/cm$^2$. It has been revealed that with this total radiation energy density a wide toner density range can be covered.

In a preferred embodiment, the radiation energy density of an individual radiation pulse is in a range from 0.5 J/cm$^2$ to 5 J/cm$^2$. The respective radiation density of the individual radiation pulses can thus be distinctly less than the required total radiation energy density that is required to fuse the toner layers with only a low toner density.

Finally, an embodiment example of the process is preferred that is characterized in that the time interval between two subsequent radiation pulses is approximately 10 ms to 1000 ms. Preferably, the time interval is selected depending on the respective radiation energy density of the radiation pulse and the required total radiation energy density that must be introduced into the toner image for its uniform fusing.

It is readily apparent from the above that in order to fuse the toner particles of the toner image transferred onto the image-carrier substrate, more than two electromagnetic radiation pulses, for example, 3, 4, or 5 radiation pulses, can be applied onto the fixing area of the image-carrier substrate in a time-delayed manner. The higher the number of the radiation pulses is, the smaller the radiation energy density of each individual one of the radiation pulses can be. Furthermore, the time interval between every two subsequent radiation pulses and the intensity and length of the individual pulses can also be varied. It is important that even areas of the toner image at low toner density are fused in a desired manner, and that in the process, the areas of the toner image with high toner density are not overheated causing bubbles to form in the molten mass.

In order to achieve the purpose of the invention, a process is also proposed that functions for the fixing of a single or multicolor toner image whereby to fuse the toner image it is impinged with electromagnetic radiation. The process is characterized in that the toner image is predominantly impinged with electromagnetic radiation in the UV range (ultraviolet range). The wavelength range of the UV radiation is in a range from 200 nm to 380 nm. It has been revealed that within this wavelength range, the absorption capacity of the toner with the colors cyan, magenta, and yellow, hereinafter referred to simply as "process color toners", and black are similar to each other, since the absorption is done predominantly through the toner resin. Since the multi-color toner image is only impinged with the UV range of electromagnetic radiation, a uniform fusing and fixing of the different toners are ensured. In this way, a uniform gloss can be achieved over the entire toner image.

According to an additional embodiment of the invention, it is provided that the electromagnetic radiation is emitted by at least one flash lamp, and that except for the UV portion of the radiation, the remaining spectral range of electromagnetic radiation is filtered out before the radiation hits the toner that is to be fixed. The fixing range of the toner image is thus impinged with timed electromagnetic radiation in the UV range. Since the undesired wave range of the radiation emitted by the flash lamp is filtered out, practically any radiation source can be used, for example, a xenon lamp.

An embodiment example is especially preferred in which at least one radiation pulse emitted by the flash lamp has a high UV-portion in relation to the total radiation. This can, for example, be ensured with a xenon/mercury lamp that, after reaching its operating temperature, which is above the boiling point of mercury, emits an electromagnetic radiation that has a clearly higher UV-portion compared to a conventional xenon lamp.

In a preferred embodiment of the invention, it is provided that at least two short radiation pulses each having a high UV-portion are applied with a very small time delay onto the toner to be fixed. The radiation pulses/flashes are thus triggered such a short time after each other that they overlap each other, resulting in a radiation pulse that is almost longer. For example, a first lamp can emit a short radiation pulse, whereby a second lamp then only emits a radiation pulse if the power of the first radiation pulse has fallen below a certain limit value. Then, a third radiation pulse can be emitted if in turn the power of the second radiation pulse falls below a certain limit value. Provided additional radiation pulses are applied onto the fixing area, they can be correspondingly triggered in the manner mentioned above, i.e. with the corresponding time interval between two radiation pulses that follow each other. When the individual pulses are shortened, the color-dependent fixing UV-portion increases.

The fixing conditions are preferably adjusted to the toner of the toner image, which has the lowest absorption capacity of the UV radiation. If the toner image has, for example, a yellow toner layer, then during continuous electromagnetic radiation, its time duration and/or the level of its energy density are adapted to it, and during a clock-pulsed electromagnetic radiation, the number of the radiation pulses applied to the fixing area, their respective energy density and/or time interval between two successive radiation pulses and the like, are adapted to it. This means the fixing conditions are tuned such that on the one hand, even a yellow toner is fused in the desired manner, and on the other hand, an overheating of the image-carrier substrate and the remaining color toners is prevented with certainty.

Finally, an embodiment example of the process is preferred in which to adjust its different absorption capacity of electromagnetic radiation, the respective fusing properties of the different-colored toners are optimized depending on the respective toner color so that the color-dependent differences in the energy absorption are equilibrated. This can be done, for example, by modification of the molecular weight distribution or the glass transformation point or by different mixture ratios of two or more polymers or by the addition of different concentrations of other additives that influence the fusing behavior, such as for example, waxes. In this way, a uniform fusing of the different colored toners is achieved. Furthermore, damages in the toner image, for example, fusing explosions, can be prevented with certainty.

In order to solve the purpose of the invention, a digital printer and copier machine proposed which includes a fixing device with at least one radiation source, by which clocked electromagnetic radiation, i.e. radiation pulses, can be applied onto the image-carrier substrate. The machine has, furthermore, at least one power supply unit for the radiation source. The radiation source is, for example, made of a xenon lamp or a xenon/mercury lamp. The machine is characterized in that using the radiation source at least two time-delayed radiation pulses can be applied on the same area of the image-carrier substrate. The time interval between two successive radiation pulses can preferably be varied. Furthermore, the energy density of the respective radiation pulses can be adapted to the toner that is to be fixed on the image-carrier substrate. According to the invention, the fixing area of the toner image is thus irradiated with several radiation pulses so that their emitted total radiation energy density is sufficiently high to uniformly fuse and fix the toner areas with low and high toner densities.

In order to solve the purpose of the invention, a digital printer and copier machine is proposed which includes a fixing device with at least one radiation source, for example a flash lamp, for applying clocked electromagnetic onto the image-carrier substrate. The machine is characterized in that the radiation source is a xenon/mercury (Xe/Hg) lamp. The Xe/Hg lamp has several temperature-dependent operating states. A first operating state is present if the temperature of the Xe/Hg lamp is still below the boiling point of mercury. In this operating state, the Xe/Hg lamp acts like a normal xenon/mercury lamp with corresponding UV-radiation portion. A second operating state of the Xe/Hg lamp is achieved after it has a temperature that is above the boiling point of mercury, and the mercury is thus evaporated. In this operating state, the Xe/Hg lamp emits a considerable portion of its radiation flow in the UV-range. The machine according to the invention can be used in an especially advantageous way for the fixing of color toner images.

In an especially advantageous embodiment example of the machine, at least one filter is allocated to the radiation path of the Xe/Hg lamp and the image-carrier substrate, which lets only the UV portion of the electromagnetic radiation through. In this way, for process color toners, a uniform fusing and fixing of the toners onto the image-carrier substrate can be ensured because of their relatively equivalent absorption capacity in the UV-range, even without special absorbers having to be added to the toners for this purpose.

The invention, and its objects and advantages, will become more apparent in the detailed description of the preferred embodiment presented below.

BRIEF DESCRIPTION OF THE DRAWINGS

The invention is explained in greater detail using the drawings. Shown are.

DETAILED DESCRIPTION OF THE INVENTION

In the following, it is assumed purely for the purposes of example, that the digital printer or copier machine 1 operates according to the electrographic or electrophotographic process and functions to fix a liquid or dry toner onto an image-carrier substrate. The substrate can, for example, be made out of paper or cardboard and can be a sheet or a continuous web. It is assumed purely for the purposes of example in the following that the machine 1 functions to print onto paper.

Figure 1:
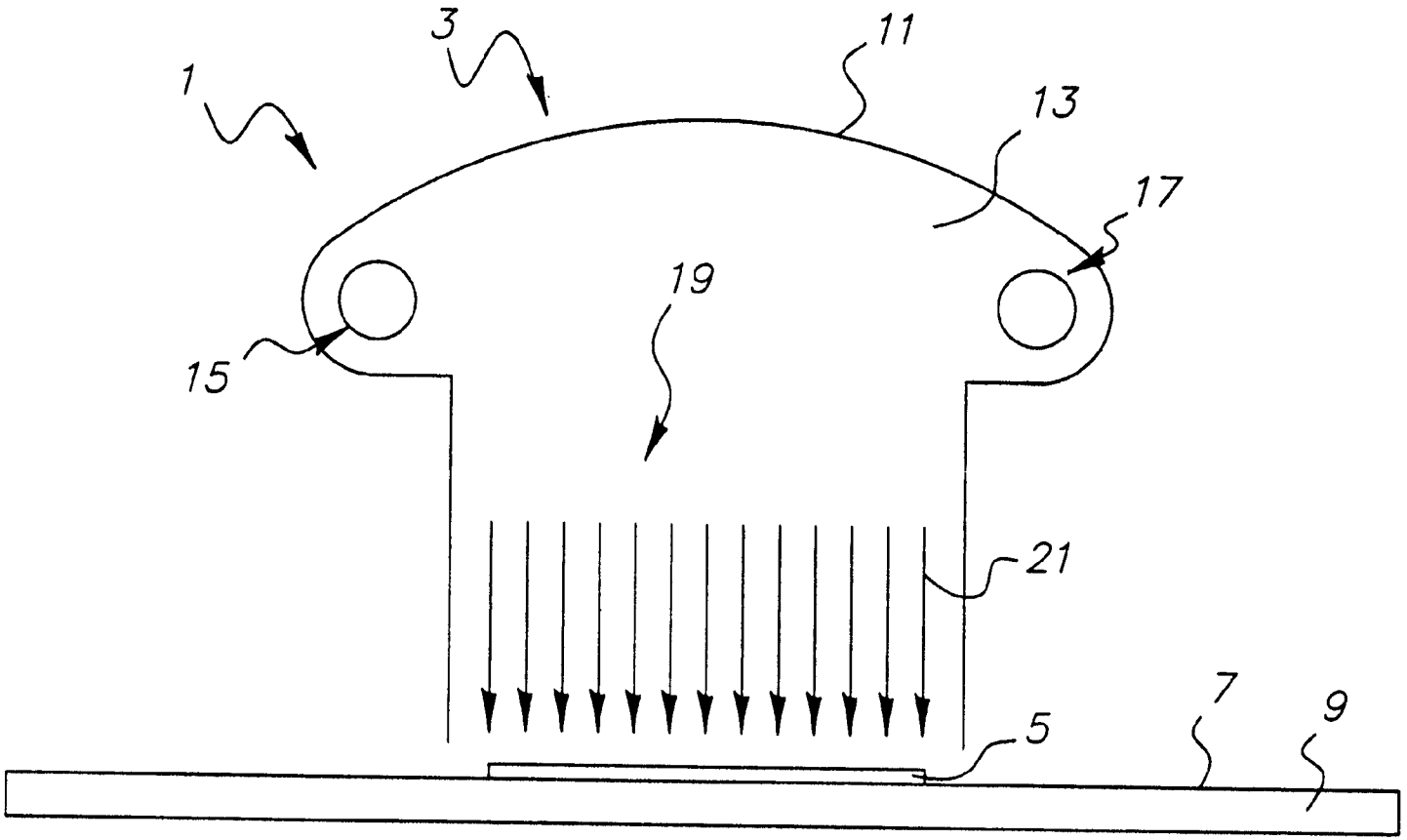
FIGS. 1 to 3 each show an embodiment example of a fixing device.

FIG. 1 shows a cross-section through an embodiment example of the machine 1, namely through a fixing device 3, which functions for fixing a toner image 5 that is located on the recording surface 7 of a paper sheet, hereinafter referred to simply as "paper 9". Using a transport device (not shown), the paper 9 is guided past the fixing device 3 along a transport path. The transport direction of the paper 9 is in the direction parallel to the image plane of FIG. 1.

The fixing device 3 contains a reflector 11 that has a mushroom-shaped outer contour in the cross-section. In the inner space 13 of the reflector 11, a first radiation source 15 and a second radiation source 17 are arranged, which each are made of a lamp, for example, a xenon lamp or a xenon/mercury vapor discharge lamp. The radiation sources 15,17 are each arranged in the upper area of the reflector 11 at a lateral offset to a radiation path 19 of the reflector 11 that has an opening towards the paper 9. Based on this arrangement, the electromagnetic radiation emitted by the radiation sources 15,17 is completely reflected on the wall of the inner space 13 of the reflector 11 and thus gets via the radiation path 19 to the toner image 5 and/or the paper 9. In other words, the design of the reflector 11 and the arrangement of the radiation sources 15,17 are selected according to the invention so that the electromagnetic radiation emitted by the radiation sources 15,17 does not radiate directly into the fixing area. The volume of the reflector 11 is preferably as small as possible in order to obtain a maximum in intensity.

The radiation sources 15,17 are operated electrically. For this purpose, at least one power supply unit (not shown) is provided. Furthermore, the radiation sources 15,17 are coupled to an electronic control unit (not shown), by which the operating parameters of the radiation sources 15,17 can be adjusted. Preferably, using the radiation sources 15,17 at least one radiation pulse is emitted from each, in order to fix the toner image 5 onto the paper 9, i.e. to fuse and cure it, whereby the toner is bonded to the paper 9 in the known way.

In another embodiment variation it is provided that the radiation sources 15,17, in order to fix the toner image 5, continuously emit electromagnetic radiation that is reflected via the radiation path 19 into the fixing area. The radiation 21 emitted by the radiation sources 15,17 and reflected by the reflector 11 into the radiation path is indicated with arrows. Using the individually adjustable radiation sources 15,17 it is also possible that in order to fuse the toner image 5 at first only one radiation pulse is emitted from one of the two radiation sources and that after a certain adjustable time interval after the first radiation pulse, a second radiation pulse is emitted by the other radiation source. Alternatively, it is possible that two radiation sources 15,17 simultaneously each emit a radiation pulse and then with a desired time delay, each of the two radiation sources 15,17 emits another radiation pulse or from only one of the two radiation sources 15,17, another radiation pulse is emitted. The time delay between the first radiation pulse applied onto the toner image 5 and the second radiation pulse can be adjusted using the electronic control unit.

Figure 2:
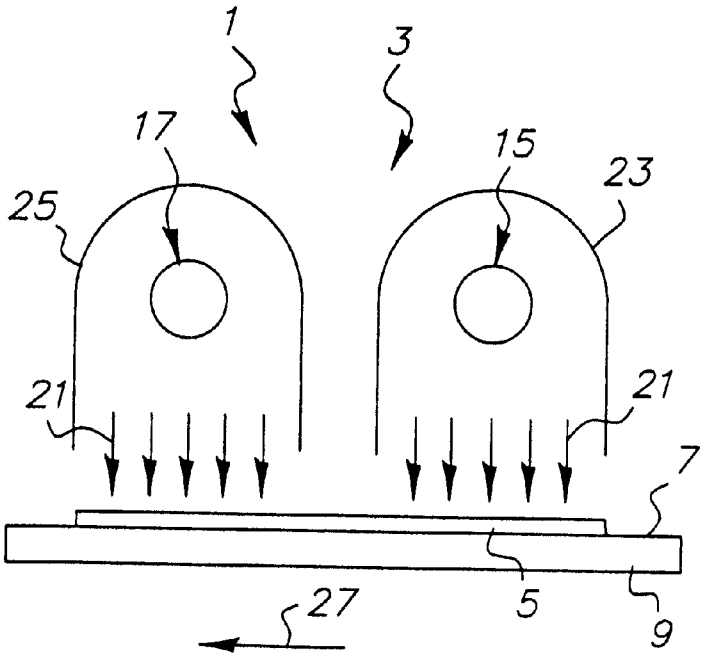

FIG. 2 shows a longitudinal section through an additional embodiment example of the fixing device 3, which in total has two reflectors 23 and 25, which are arranged above the transport path of the paper 9 and at a small distance behind each other in the paper transport direction 27. In the reflector 23, the first radiation source 15 is arranged and in the subsequently arranged second reflector 25, the second radiation source 17 is arranged. The reflectors 23, 25 are constructed in such a way that the electromagnetic radiation 21 that is emitted by the radiation sources 15,17 can be clocked or continuously directly applied, i.e. without reflection on the inner wall of the reflectors 23, 25, onto the toner image 5 and the paper 9. In the embodiment example shown in the FIG. 2 the preferably clocked electromagnetic radiation of the radiation sources 15,17 is applied at different sites within the fixing device 3 onto the toner image 5. The time delay between the radiation pulse emitted by the first radiation source 15 and the radiation pulse emitted by the second, subsequent radiation source 17 can be varied here, for example, by adjustment of the transport speed of the paper 9, which is guided past the reflectors 23, 25 at a defined speed, or through a variable position of the second radiation source.

Figure 3:
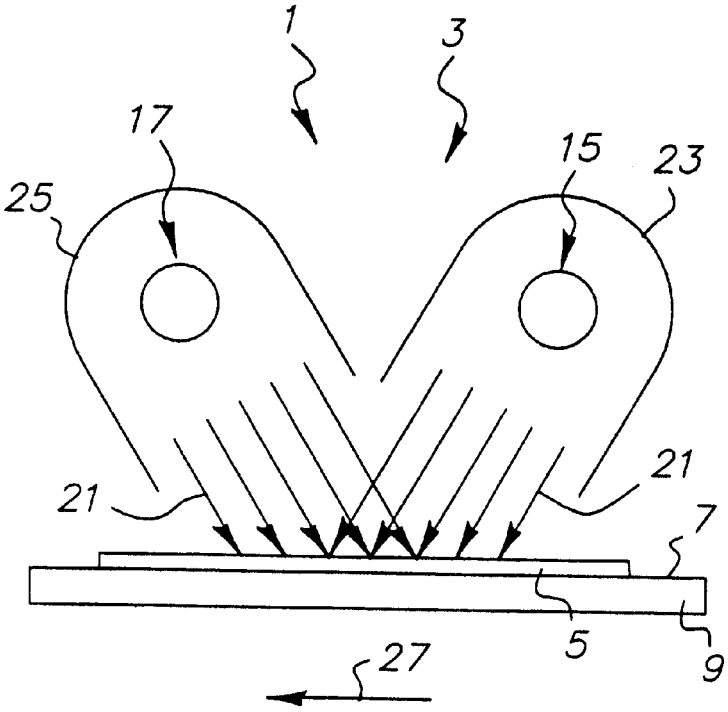

FIG. 3 shows a longitudinal section through a third embodiment example of the fixing device 3, which is distinguished from the embodiment example described using FIG. 2 only in that the reflectors 23,25 are tipped towards each other in such a way that the electromagnetic radiation emitted from the first radiation source 15 and the second radiation source 17 hit the same area within the fixing device 3.

It is common to the embodiment examples described using FIGS. 1 to 3 that each of the radiation sources 15,17 are coupled either to their power supply unit or that for all radiation sources of a fixing unit, only one power supply unit is provided. Therefore, using the radiation sources 15,17, at least two radiation pulses are applied onto the toner image 5, in order to fuse it and fix it onto the paper 9. The at least two radiation pulses are applied in a time-delayed manner onto the same area of the paper 9, i.e. at first a first radiation pulse is applied onto the paper 9 and after a certain adjustable time, the second radiation pulse is triggered. The radiation pulses thus do not hit the toner image 5 to be fixed at the same time so that an overheating of the toner image 5 and the paper 9 can be practically ruled out.

As an alternative to the aforementioned embodiment examples, a fixing unit can also be used with only one radiation source for fusing the toner image 5. The radiation source emits at least two required radiation pulses. For this purpose, the radiation source is coupled to a power supply unit, which is suitable in order to trigger two radiation pulses at a small time interval apart from each other. Of course, it is also possible that the one radiation source is connected to two different radiation supply units, by which at least one radiation pulse can be triggered in the one radiation source at a time.

The interval between two subsequent radiation pulses and the radiation energy density of the respective radiation pulses are selected in such a way according to the invention that even areas of the toner image with a low toner density are fused in a desired manner, without the areas of the toner image that have a high toner density being overheated in the process, which would lead to a bubble formation in the fused toner.

In the following, a measuring device is described using FIG. 4, with which the total radiation energy density of the at least two radiation pulses in the areas of the toner image with different toner densities is measured as a function of the time interval between the radiation pulses that follow each other. In FIG. 5, the evaluation of the measurements is shown in graphic form.

Figure 4:
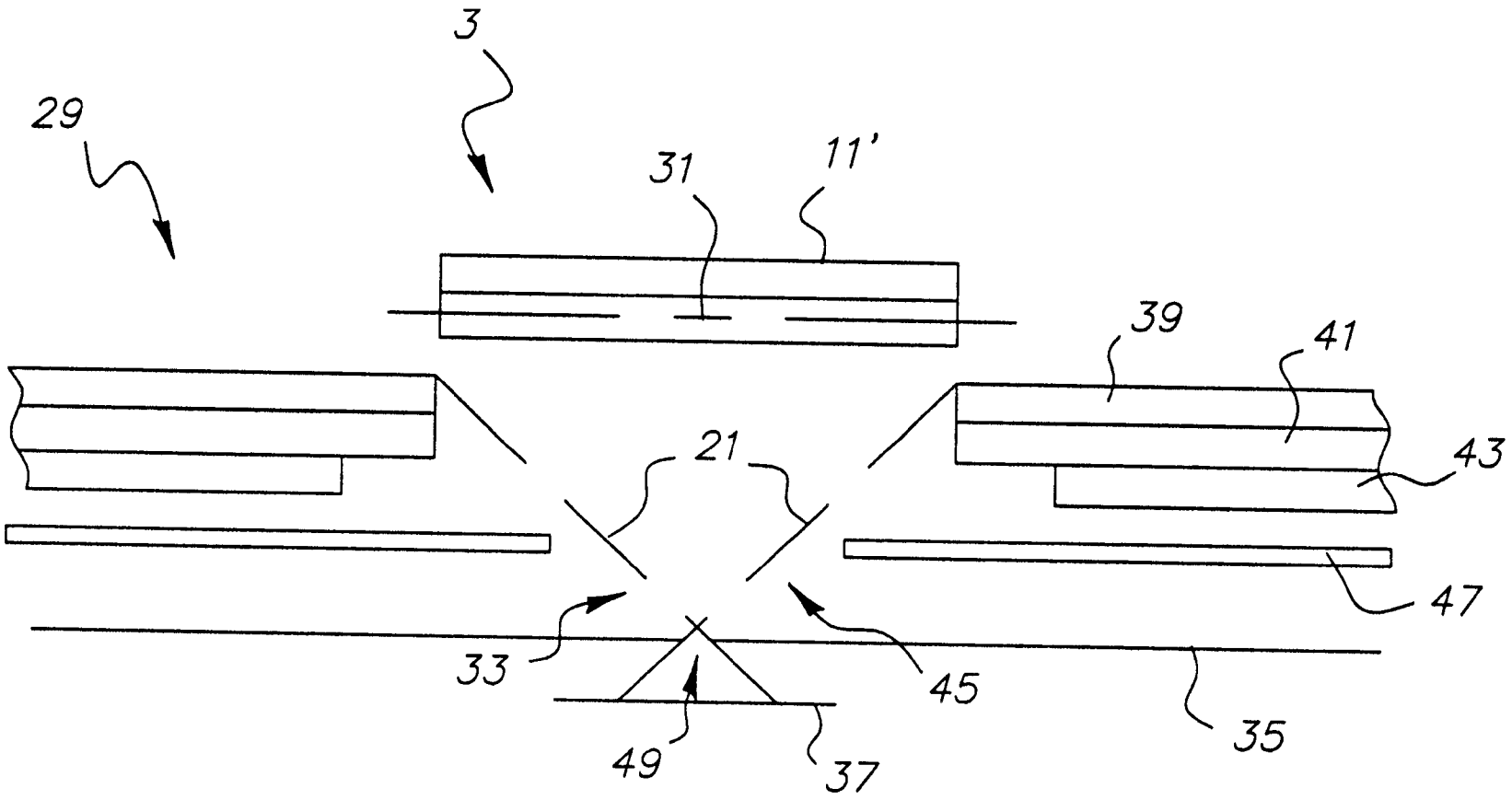
FIG. 4 shows a longitudinal section through a measuring device.
Figure 5:
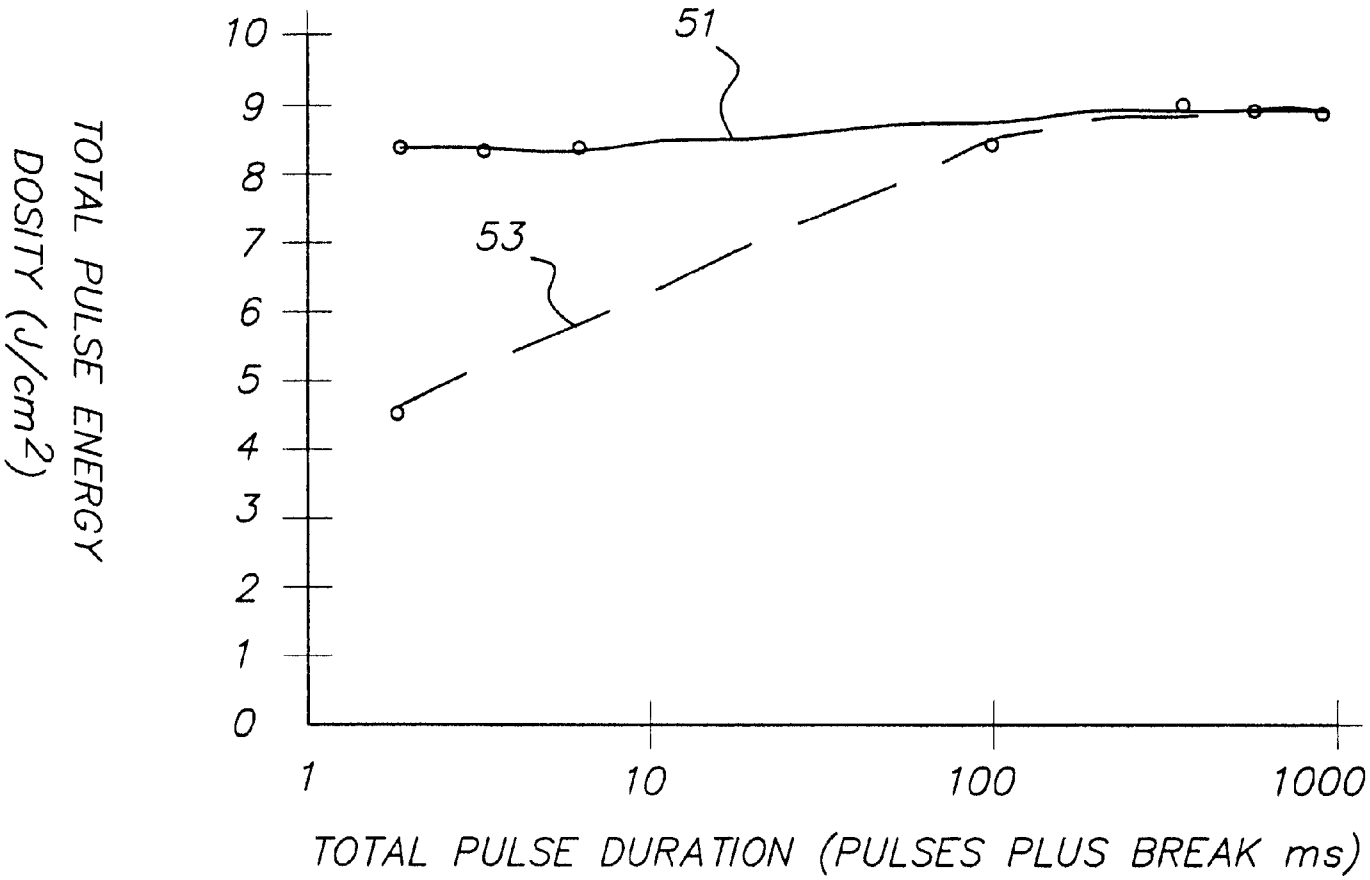
FIG. 5 is a diagram, in which limit values of the energy density of areas with low toner density and areas with high toner density are shown as a function of the time duration between two successive radiation pulses.

The measuring device 29 for measuring the energy density, shown in FIG. 4 in longitudinal section, has a schematically shown reflector 11, in which two flash lamps 31 with an inner diameter of 4 mm are arranged parallel to each other. Of the flash lamps 31, only one can be seen in the diagram according to FIG. 4. Of the electromagnetic radiation 21 emitted by the flash lamps 31, only their limit radiation is shown in FIG. 4.

Below the plane 35, a measuring surface 37 of a bolometer (not shown) is indicated, which is used to measure the radiation energy density of the electromagnetic radiation pulses emitted by the flash lamps 31. The measuring device 29 has, furthermore, a quartz housing 39 functioning as an explosion protection and an insulator plate 41. Furthermore, a part of the housing 43 of the measuring device 29 can be recognized.

The two flash lamps 31 have xenon present under 0.5 bar and 40 mg of mercury in order to enlarge the UV portion of the electromagnetic radiation. The flash lamps 31 are arranged parallel to each other within the reflector. Via an opening 45 of a plate 47 lying across from the paper plane 35, the size of the irradiated area (surface 33) of the paper plane 35 is set. The measuring surface 37 of the bolometer is irradiated via a 9 mm large opening 49 in the paper plane 35. Using the flash lamps 31 two separate, equivalent radiation pulses each having 2.5 ms pulse width (half-value time) are triggered at different time intervals between the radiation pulses. Up to a time interval of approximately 12 ms, the two radiation pulses overlap each other. Only at a larger time interval between the radiation pulses do the radiation pulses each act as separate radiation pulses. The time intervals between the separate radiation pulses are varied between 0 ms and 1000 ms and the energy density of the respective radiation pulses are varied in a range between 0.5 J/cm$^2$ and 5 J/cm$^2$. Print samples using the same toner and the same paper are used continuously, namely cyan toner and coated paper with 130 g/cm$^2$. The cyan toner was applied onto the paper in such a way that the areas with a toner density of 10% (reflection density in approx. 0.1) and 290% (1.7 mg/cm$^2$) are formed. The measurement results are shown graphically in the diagram shown in FIG. 5.

On the abscissa axis (X-axis) of the diagram in FIG. 5, the total radiation duration, i.e. the total of the time duration of the radiation pulses and the time interval between the beginning of the first radiation pulse and the end of the second radiation pulse is plotted in milliseconds (ms) in logarithmic scale. On the ordinate axis (Y-axis) of the diagram, the total radiation energy density of the two radiation pulses is plotted. The unit is J/cm$^2$. A first characteristic line 51 shows the progression of the total radiation energy density for areas with a toner density of 10%, which at least is required in order to fuse the toner particles located in this area in the desired manner. A second characteristic line 53 shows the progression of the upper limit of the total radiation energy density for areas with a toner density of 290%, at which it just does not yet come to a bubble formation in this toner layer as the result of a moisture discharge from the paper due to overheating. As can be seen using the progression of the first characteristic line 51, in areas with a low toner density it is of only a very small significance how large the time interval between the subsequent radiation pulses is. The total radiation energy density applied at a 10% toner density into the toner layer is essentially between 8.3 J/cm$^2$ and 9 J/cm$^2$.

As the progression of the second characteristic line 53 shows, the areas with a toner density of 290% exhibit a strong dependence on the size of the time interval between the two radiation pulses. If the time interval between the radiation pulses is only very small, then the energy density, at which at bubble formation occurs in the fused toner layer in areas with a toner density of 290%, is relatively small and is clearly below 8 J/cm$^2$. The larger the time interval between the two subsequent radiation pulses, the larger the limit value of the energy density at which a bubble formation begins. In the area, in which characteristic lines 51, 53 cross and/or lie on top of each other, a "fixing window" exists, for which with two equivalent radiation pulses whose time interval from each other is approximately 200 ms to 800 ms, a total radiation energy density of 9 J/cm$^2$ is reached in all areas of the toner image. When this fixing parameter is maintained, all areas of the toner image, which have a toner density of 10% to 290%, are fused in the desired manner without a bubble formation occurring in parallel, especially in the areas with high toner density.

From the aforementioned it is clear that with the process according to the invention a uniform fusing of the total toner image can be ensured independently of its toner densities in an advantageous way. It is clear that depending on which absorption capacity the image-carrier substrate has, in which range the toner density of the toner image varies, which process color toners are used and their absorption capacity, the time interval between the at least two subsequent radiation pulses and the number of the radiation pulses applied onto the image-carrier substrate can be selected in a corresponding manner. It is important that the areas of the toner image with high toner density are not overheated and that in spite of that, the areas with an only low toner density are fused in the desired manner.

Figure 6:
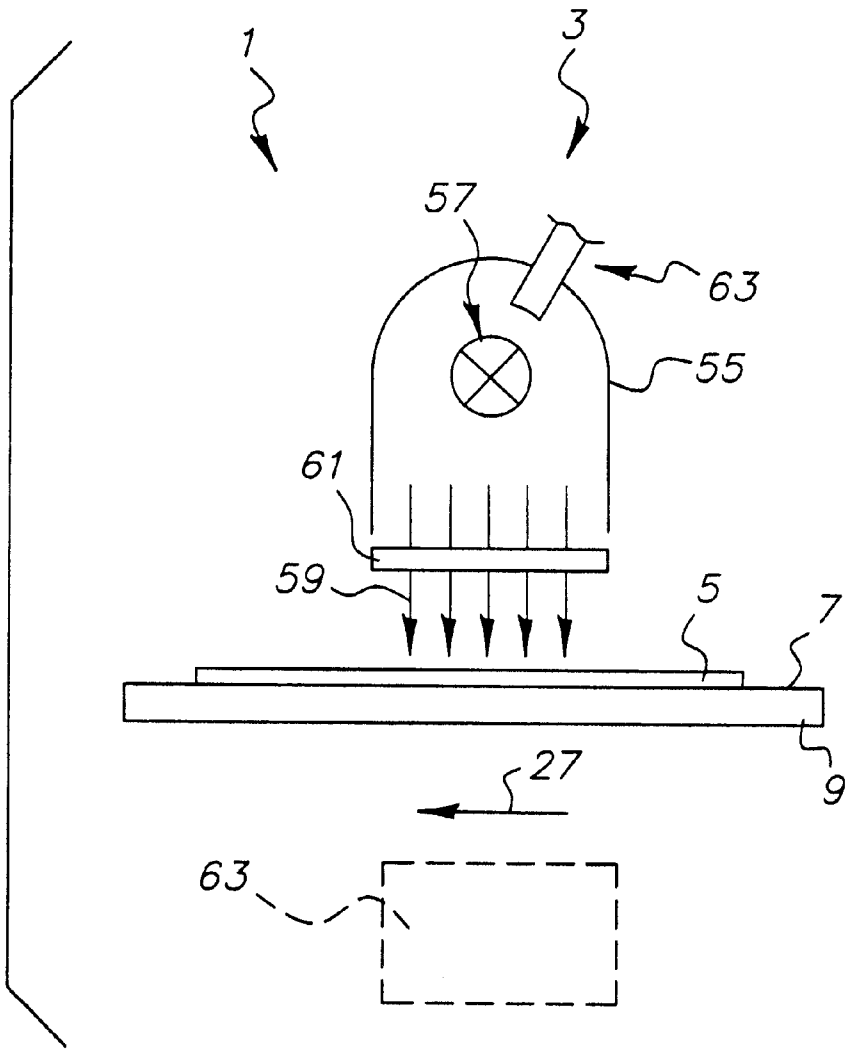
FIG. 6 shows a longitudinal section through an additional embodiment example of the fixing device.

FIG. 6 shows an additional embodiment example of the digital printer or copier machine 1, which has a fixing device 3 with a radiation source 57 arranged in a reflector 55. The reflector 55 is opened towards the transport path of the paper 9 so that the electromagnetic radiation 59 emitted by the radiation source 57 gets onto the paper 9 that has the toner image 5 located on it and is guided past the fixing device 3.

The radiation source 57 is made of a xenon/mercury lamp, whose radiation has a very high UV-portion. According to the invention, it is provided that to fuse the toner image 5, only the UV portion of the electromagnetic radiation of the xenon/mercury vapor discharge lamp is used. For this purpose, a cooled filter 61 is provided in the radiation path between the radiation source 57 and the toner image 5, which only lets through the UV-portion of the radiation.

The xenon/mercury vapor discharge lamp is connected to a power supply unit (not shown) and an electronic control unit. According to the invention, the toner image 5 and the paper 9 are not impinged continuously with electromagnetic radiation, but instead they are impinged with radiation pulses. The xenon/mercury vapor discharge lamp is controlled in such a manner for this purpose that it emits only at least one radiation pulse (light flash). Based on this design and control of the fixing device 3, exclusively clocked electromagnetic radiation is used in the UV range in order to fuse the toner image 5.

The xenon/mercury vapor discharge lamp is operated in the embodiment example shown in FIG. 6 in the "simmer mode", i.e. it is constantly held at its operating temperature, at which the mercury in the lamp is evaporated, so that the UV portion of its radiation is at the highest. In order to heat up and/or pre-heat the xenon/mercury vapor discharge lamp, a heating device 63 is provided. The heating device 63, here purely for the purpose of example, is arranged above the reflector 55 and impinges the xenon/mercury vapor discharge lamp with infrared radiation, hot air and/or microwave radiation, so that it constantly has a temperature that is above the boiling point of mercury.

In FIG. 6, an additional arrangement possibility of the heating device 63 is shown with dashed lines. The heating device here is arranged below the reflector and the transport plane of the paper 9, and to be precise, opposite the opening of the reflector 55. A non-contact heating of the radiation source 57 always occurs here if no paper 9 is located in the radiation path between the reflector and the paper. It is advantageous in this embodiment example that the outer wall of the reflector 55 must not be interrupted.

In another embodiment example not shown in the figures, it is provided that into the xenon/mercury vapor discharge lamp, a heating device is integrated which makes possible a compact construction of the fixing device 3.

In another embodiment example, the pre-heating occurs through several flashes prior to the beginning of the actual toner fixing. In the process, the paper guide can be covered in order to prevent an overheating.

By the xenon/mercury vapor discharge lamp being constantly held at its operating temperature, it has an extended lifetime.

The fixing device 3 described in FIG. 6 is suitable for fixing single-color or multi-color toner images. By the respective toner image being exclusively only impinged with electromagnetic radiation in the UV range, it can be ensured that also for different-colored toners, which because of their color can have a different absorption capacity, a uniform fusing of the toner can occur without in the process one of the toners or several of the toners or the paper being overheated.

Figure 7:
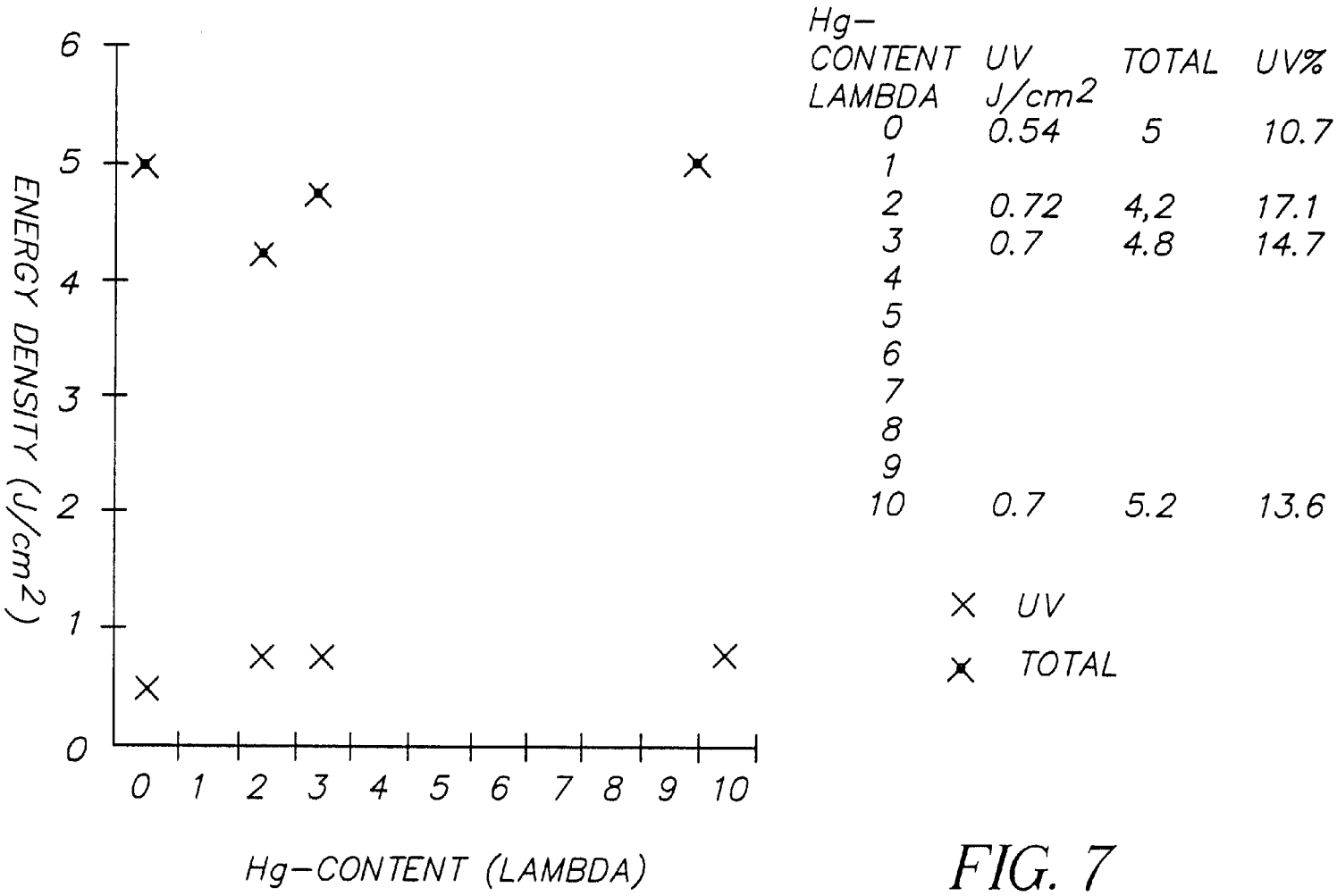
FIG. 7 is a diagram, in which the energy density of a radiation pulse of a mercury flash lamp as a function of its mercury content is shown.

FIG. 7 shows a diagram in which on the abscissa axis (X-axis), the mercury content of the xenon/mercury vapor discharge lamp is plotted, and on the ordinate axis (Y-axis), the energy density of the UV portion and that of the total electromagnetic radiation of the xenon/mercury vapor discharge lamp is plotted. Next to the diagram, a table is shown in which quantitative data of the radiation emitted by the xenon/mercury vapor discharge lamp and/or its UV portion is given as a function of the mercury vapor content of the lamp. The scale of 0 to 10 for the mercury content has no units, since it is only a comparative measure. From the diagram and the table, it can be seen that the UV portion of the radiation emitted by the xenon/mercury vapor discharge lamp is essentially independent of the mercury content and has a portion of the total radiation that is in the range from 13% to 17%. In the process, the energy density of the emitted radiation pulse for the UV portion is uniformly in the range of 0.7 J/cm$^2$.

The embodiment examples are not to be understood as a restriction of the invention. Moreover, numerous alterations and modifications are possible within the frame of the disclosure presented, in particular such variations, elements and combinations and/or materials, which, for example, by the combination or modification of individual characteristics and/or elements or process steps, described in connection with the general description and embodiment forms as well as claims, and contained in the drawings, can be ascertained by the expert in regard to the achieving the purpose and lead, through combinable characteristics, to a new object or to new process steps and/or process step sequences.

The invention has been described in detail with particular reference to certain preferred embodiments thereof, but it will be understood that variations and modifications can be effected within the spirit and scope of the invention.

| Parts List | |
|---|---|
| 1 | Machine |
| 3 | Fixing device |
| 5 | Toner image |
| 7 | Recording surface |
| 9 | Paper |
| 13 | Inner space |
| 15 | 1st radiation source |
| 17 | 2nd radiation source |
| 19 | Radiation path |
| 21 | Radiation |
| 23 | Reflector |
| 25 | Reflector |
| 27 | Transport direction |
| 29 | Measurement device |
| 31 | Flash lamp |
| 33 | Surface |
| 35 | Paper plane |
| 37 | Measurement surface |

-continued

| Parts List | |
|---|---|
| 39 | Quartz housing |
| 41 | Insulator plate |
| 43 | Housing |
| 45 | Opening |
| 47 | Plate |
| 49 | Opening |
| 51 | 1st characteristic line |
| 53 | 2nd characteristic line |
| 55 | Reflector |
| 57 | Radiation source |
| 59 | Radiation |
| 61 | Filter |
| 63 | Heating device |

What is claimed is:

1. Process for fixing a toner image, made up of toner particles, transferred onto an area of an image-carrier substrate comprising the step of fusing the toner particles of said toner image to said image-carrier substrate by at least two electromagnetic radiation pulses, a radiation energy density of each one individual radiation pulse being in a range from 0.5 J/cm$^2$ to 5 J/cm$^2$, applied onto the same area of said image-carrier substrate in a time-delayed manner.

2. Process according to claim 1, wherein a total radiation energy density of the at least two radiation pulses, which is required to fuse the toner particles of the toner image in the desired manner, is equally as large at very low toner particle densities and at high toner particle densities.

3. Process according to claim 1, wherein the total radiation energy density is in a range from 1 J/cm$^2$ to 18 J/cm$^2$, preferably from 3 J/cm$^2$ to 10 J/cm$^2$.

4. Process according to claim 1, wherein the radiation energy density of each radiation pulse is smaller than the limit value of the radiation energy density at which the toner particles of the toner image to be fixed is overheated.

5. Process according to claim 1, wherein a time interval between two subsequent radiation pulses is approximately 10 ms to 1000 ms, preferably 200 ms to 600 ms.

6. Process according to claim 1, wherein electromagnetic radiation of said at least two electromagnetic radiation pulses is in the UV range.

7. Process according to claim 6, wherein said electromagnetic radiation is emitted by at least one flash lamp, said electromagnetic radiation is filtered such that only the UV portion of said electromagnetic spectral range radiation hits the toner particles of the toner image that is to be fixed.

8. Process according to claim 6, wherein at least one radiation pulse emitted by said at least one flash lamp has a UV-portion greater than 10% in relation to its total radiation spectrum.

9. Process according to claim 6, wherein parameters for the fixing are adjusted to the toner particles of the toner image, which have the lowest absorption capacity of UV radiation.

10. Process according to claim 6, wherein toner particles are used that contain additional absorbers for non-visible, infrared and/or UV portions of the electromagnetic radiation.

11. Process according to claim 6, wherein different-colored toner particles, depending on their respective colors, contain additional absorbers, based on respective fusing properties, so that color-dependent differences in electromagnetic radiation energy absorption capacity are equilibrated.

12. Process according to claim 6, wherein equilibration of the electromagnetic radiation energy absorption of different-colored toner particles for fusing is influenced in the desired manner by modification of molecular weight distribution, glass transformation point of toner particle polymer, different mixture ratios of two or more toner particle polymers, or addition of different concentrations of other additives that influence fusing behavior of said toner particles.

13. Electrostatic printer or copier machine which has a fixing device for fixing a toner image, made up of toner particles, on an area of an image-carrier substrate, said fixing device comprising: at least one radiation source for applying clocked electromagnetic radiation onto the image-carrier substrate, at least one power supply unit for said radiation source, and a control for said power supply whereby said radiation source provides at least two time-delayed radiation pulses with a radiation density of each one individual radiation pulse being in a range of from 0.5 $J/cm^2$ to 5 $J/cm^2$, applied on the same image-carrier area of said substrate.

14. Machine according to claim 13, wherein said radiation source is coupled to at least two power supply units, which in response to said control, trigger at least two radiation pulses in said radiation source.

15. Machine according to claim 13, wherein each of said at least two radiation sources are arranged in respective reflectors and wherein radiation pluses from said at least two radiation sources are reflected by said respective reflectors along paths which cross each other.

16. Machine according to claim 13, wherein said radiation source is a xenon/mercury lamp, and wherein radiation is provided along a radiation path between said xenon/mercury lamp and said image-carrier said substrate, with at least one filter in said radiation path, said filter only allowing UV-portion of the electromagnetic radiation there-through.

17. Machine according to claim 16, wherein a heating device is provided for heating said xenon/mercury lamp to its operating temperature above a boiling point of mercury.

18. Machine according to claim 17, wherein said heating device is integrated into said xenon/mercury lamp.

19. Machine according to claim 17, wherein said heating device is arranged outside said xenon/mercury vapor discharge lamp and at a distance from it, whereby is using said heating device, said xenon/mercury lamp can be impinged with infrared radiation, hot air and/or microwave radiation.

* * * * *